US010093002B2

(12) United States Patent
Hu

(10) Patent No.: US 10,093,002 B2
(45) **Date of Patent: *Oct. 9, 2018**

(54) RATCHET WRENCH WITH TOOTH BREAKAGE RESISTANCE

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 116 days.

This patent is subject to a terminal disclaimer.

(21) Appl. No.: 15/251,563

(22) Filed: Aug. 30, 2016

(65) Prior Publication Data

US 2017/0326711 A1 Nov. 16, 2017

(30) Foreign Application Priority Data

May 10, 2016 (TW) ..... 105114428 A

(51) Int. Cl.
*B25B 13/46* (2006.01)
*B25B 23/00* (2006.01)

(52) U.S. Cl.
CPC ..... *B25B 13/465* (2013.01); *B25B 23/0035* (2013.01)

(58) Field of Classification Search
CPC ..... B25B 13/465
USPC ..... 81/62
See application file for complete search history.

(56) References Cited

U.S. PATENT DOCUMENTS 6,457,386 B1 10/2002 Chiang
7,444,903 B1 * 11/2008 Li ..... B25B 13/463 81/60
8,291,792 B2 * 10/2012 Yang ..... B25B 13/463 81/60
9,409,284 B2 * 8/2016 Sun ..... B25B 13/463
9,862,076 B2 * 1/2018 Lai ..... B25B 13/463

* cited by examiner

*Primary Examiner* — Hadi Shakeri
(74) *Attorney, Agent, or Firm* — Alan D. Kamrath; Kamrath IP Lawfirm, P.A.

(57) ABSTRACT

A ratchet wrench with tooth breakage resistance includes a body having a driving hole and a transmission hole intersecting with the driving hole. An inner periphery of the driving hole includes two adjoining portions on opposite sides of the transmission hole. An arcuate portion extends between the two adjoining portions. A tooth breakage preventing device is mounted in the arcuate portion and is configured to be in contact with one of first and second outer toothed sections of either of two first pawls to prevent tooth breakage between a toothed portion of the driving hole and the one of the first and second outer toothed sections of either of the two first pawls when the body is rotated to provide a ratcheting function for driving the fastener.

7 Claims, 11 Drawing Sheets

RATCHET WRENCH WITH TOOTH BREAKAGE RESISTANCE

BACKGROUND OF THE INVENTION

The present invention relates to a ratchet wrench and, more particularly, to a ratchet wrench with a tooth breakage resistance.

FIG. 5 of the drawings is a schematic diagram corresponding to FIG. 8 of U.S. Pat. No. 6,457,386. U.S. Pat. No. 6,457,386 discloses a ratchet wrench 2 including a driving member 23 having a chamber 231 in which a pair of first pawls 24 and a pair of second pawls 25 are mounted. A first annular gear 27 encloses one of the first pawls 24 and one of the second pawls 25. A second annular gear 27 encloses the other first pawl 24 and the other second pawl 25. A main body 21 of the ratchet wrench 2 includes a groove 212 for receiving the drive member 23 and a through-hole 211 communicating with the groove 212. Each of the first and second annular gears 27 includes a plurality of inner periphery teeth 271 and a plurality one-sided teeth 272. An inner periphery defining the groove 212 includes a plurality of inner teeth 215. First and second outer teeth 241, 241' on the first pawls 24 and first and second outer teeth 251, 251' on the second pawls 25 selectively engage with the inner teeth 215 of the groove 212 and the inner periphery teeth 271 of the first and second annular gears 27, prohibiting movement in a direction. The one-sided teeth 272 of the first and second annular gears 27 engage with a bevel gear 221 on an end of a drive shaft 22 to provide transmission in the reverse direction. FIG. 7 of U.S. Pat. No. 6,457,386 shows the thickness of the second pawls 25 along a rotating axis of the drive member 23 is smaller than a diameter of the through-hole 211.

When the control member 26 is pivoted, the second pawls 25 pivot to permit the first outer teeth 251 or the second outer teeth 251' of the second pawls 25 to engage with the inner periphery teeth 271 of the first and second annular gears 27, thereby adjusting the rotating direction of the drive member 23. In the state shown in FIG. 5, the first outer teeth 241 of the first pawls 24 engage with the inner teeth 215 of the groove 212, and the first outer teeth 251 of the second pawls 25 engage with the inner periphery teeth 271 of the first and second annular gears 27. Since the one-sided teeth 272 of the first and second annular gears 27 engage with the bevel gear 221 on the drive shaft 22 to permit transmission in the reverse direction, when one of the first and second annular gears 27 rotate idly, the other of the first and second annular gears 27 drives the drive member 23 to rotate. During rotation in the reverse direction, both first and second annular gears 27 rotate idly. Thus, the drive member 23 can be driven to rotate relative to the groove 212 in either direction. Thus, a user can firstly rotate the drive shaft 22 to actuate the first and second annular gears 27 via the bevel gear 221, thereby rapidly driving the drive member 23 to tighten a fastener (not shown) to a certain extent, but not achieving the completely tightened state or a desired tightened state demanded by the user.

FIG. 6 is a diagram showing a continuing operation on the ratchet wrench in the state shown in FIG. 5. Specifically, the user operates the main body 21 to rotate the drive member 23 in the counterclockwise direction. Due to engagement between the first outer teeth 241 of the first pawls 24 and the inner teeth 215 of the groove 212 and due to the engagement between the first outer teeth 251 of the second pawls 25 and the inner periphery teeth 271 of the first and second annular gears 27 (which permits movement in a single direction), the drive member 23 rotates relative to the groove 212 and drives the fastener to the desired tightness demanded by the user. Since the thickness of the first and second pawls 25 is smaller than the diameter of the through-hole 211, one of the second pawls 25 falls into the through-hole 211 of the main body 21 and comes into contact with the end of the drive shaft 22 during the rotation of the drive member 23 relative to the groove 212.

FIG. 7 is a diagram showing a continuing operation on the ratchet wrench in the state shown in FIG. 6. Specifically, the user operates the main body 21 to rotate the drive member 23 in the clockwise direction. The first and second pawls 24 and 25 pivot relative to the drive member 23, such that the first outer teeth 241 of the first pawls 24 disengage from the inner teeth 215 of the groove 212 and such that the first outer teeth 251 of the second pawls 25 disengage from the inner periphery teeth 271 of the first and second annular gears 27. At this time, the groove 212 rotates idly relative to the drive member 23. Namely, the drive member 23 is not driven and, thus, provides a ratcheting function. After the user stops rotating the main body 21, the first outer teeth 241 of the first pawls 24 and the first outer teeth 251 of the second pawls 25 respectively reengage with the inner teeth 215 of the groove 212 and the inner periphery teeth 271 of the first and second annular gears 27 under the action of the compression springs S2 and the balls R.

When the user rapidly and repeatedly proceed with the driving rotation and the idle rotation, the drive member 23 rotates relative to the groove 212 before the drive member 23 reaches a position shown in FIG. 8. FIGS. 8 and 9 show that the first pawls 24 are pressed by the balls R biased by the compression springs S2. Before complete engagement between the inner teeth 215 of the groove 212 adjacent to the through-hole 211 (see circled portion D), only one of the first outer teeth 251 of the second pawl 25 engages with one of the inner teeth 215 in the groove 212 adjacent to the through-hole 211. Furthermore, the single-tooth engagement is not complete or is called a non-complete engagement. Namely, the contact area between these two teeth 251 and 215 shown in FIG. 9 is relatively small.

With reference to FIGS. 10 and 11, if the fastener coupled with the drive member 23 requires a large torque to reach the desired tightness demanded by the user, when the user applies a force while the first outer teeth 251 of the second pawl 25 and the inner teeth 215 in the groove 212 adjacent to the through-hole 211 have a small contact area and the non-complete engagement therebetween, a section of the one of the inner teeth 215 of groove 212 facing the through-hole 211 does not have any mechanism to withstand the force acting on the one of the outer teeth 251 of the second pawl 25. As a result, the one of the inner teeth 251 of the second pawl 25, the one of the inner teeth of the groove 212 cannot withstand the torque, leading to tooth breakage, particularly the one of the inner teeth 215 of the groove 212 adjacent to the through-hole 211.

Conclusions as a result, the user applies a force to rotate the main body 21, while the first outer teeth 251 of the second pawl 25 and the inner teeth 215 in the groove 212 adjacent to the through-hole 211 have a small contact area and the non-complete engagement therebetween. When only one of the first outer teeth 251 of the second pawl 25 non-completely engages with one of the inner teeth 215 in the groove 212 adjacent to the through-hole 211, the section of the one of the inner teeth 215 of the groove 212 facing the through-hole 211 does not have any mechanism to withstand the force acting on the one of the outer teeth 251 of the second pawl 25, leading to tooth breakage.

Thus, a need exists for a novel ratchet wrench with tooth breakage resistance.

BRIEF SUMMARY OF THE INVENTION

A ratchet wrench according to the present invention includes a body having a driving hole and a transmission hole intersecting with the driving hole. The driving hole includes an inner periphery having a toothed portion with a plurality of teeth. The inner periphery of the driving hole includes two adjoining portions on opposite sides of the transmission hole in a circumferential direction of the driving hole. An arcuate portion extends between the two adjoining portions and extends across the transmission hole in the circumferential direction of the driving hole.

The ratchet wrench further includes a driving device rotatably received in the driving hole and adapted to drive a fastener. The driving device includes a driving member and two first pawls pivotably mounted to the driving member. Each of the first pawls includes first and second outer toothed sections. Each of the first and second outer toothed sections has a plurality of teeth. The first and second outer toothed sections of at least one of the first pawls are selectively engaged with the toothed portion of the driving hole. A transmission device is rotatably mounted in the transmission hole. The transmission device is configured to drive the driving member to rotate relative to the driving hole about a rotating axis. A tooth breakage preventing device is mounted in the arcuate portion. The tooth breakage preventing device is configured to be in contact with one of the first and second outer toothed sections of either of the two first pawls to prevent tooth breakage between the toothed portion of the driving hole and the one of the first and second outer toothed sections of either of the two first pawls when the body is rotated to provide a ratcheting function for driving the fastener.

The tooth breakage preventing device can include at least one contact portion configured to be selectively in contact with one of the first and second outer toothed sections of either of the two first pawls. The at least one contact portion includes a height extending from a circumference of a root circle of the toothed portion towards the driving hole in a radial direction of the root circle. Each of the plurality of teeth of the toothed portion of the driving hole has a tooth height not larger than the height of the at least one contact portion.

In an embodiment, the height of the at least one contact portion is larger than the tooth height of the toothed portion of the driving hole, and the at least one contact portion is a protrusion extending from the circumference of the root circle of the toothed portion towards the driving hole in the radial direction of the root circle.

In another embodiment, the height of the at least one contact portion is equal to the tooth height of the toothed portion of the driving hole, and the at least one contact portion and the two adjoining portions are located in the circumferential direction of the driving hole.

In an embodiment, the driving hole is defined in an end of the body and extends along the rotating axis. The at least one contact portion of the tooth breakage preventing device has an arc length in the circumferential direction of the driving hole centered on the rotating axis. Each of the two first pawls includes an arcuate section between the first and second outer toothed sections. Each of the first and second outer toothed sections includes a plurality of teeth. Each of the plurality of teeth of each of the first and second outer toothed sections has a tooth thickness. A ratio of the arc length to the tooth thickness is not smaller than 0.5.

In an embodiment, the at least one contact portion of the tooth breakage preventing device includes two contact portions integrally formed with the two adjoining portions, respectively. The two contact portions have two arcuate faces, respectively. The two arcuate faces are selectively in contact with one of the first and second outer toothed sections of either of the two first pawls. The two adjoining portions are located in an intersection between the driving hole and the transmission hole and are symmetric to each other. The two arcuate faces of the two contact portions are symmetric to each other.

The present invention will become clearer in light of the following detailed description of illustrative embodiments of this invention described in connection with the drawings.

DETAILED DESCRIPTION OF THE INVENTION

Figure 1:
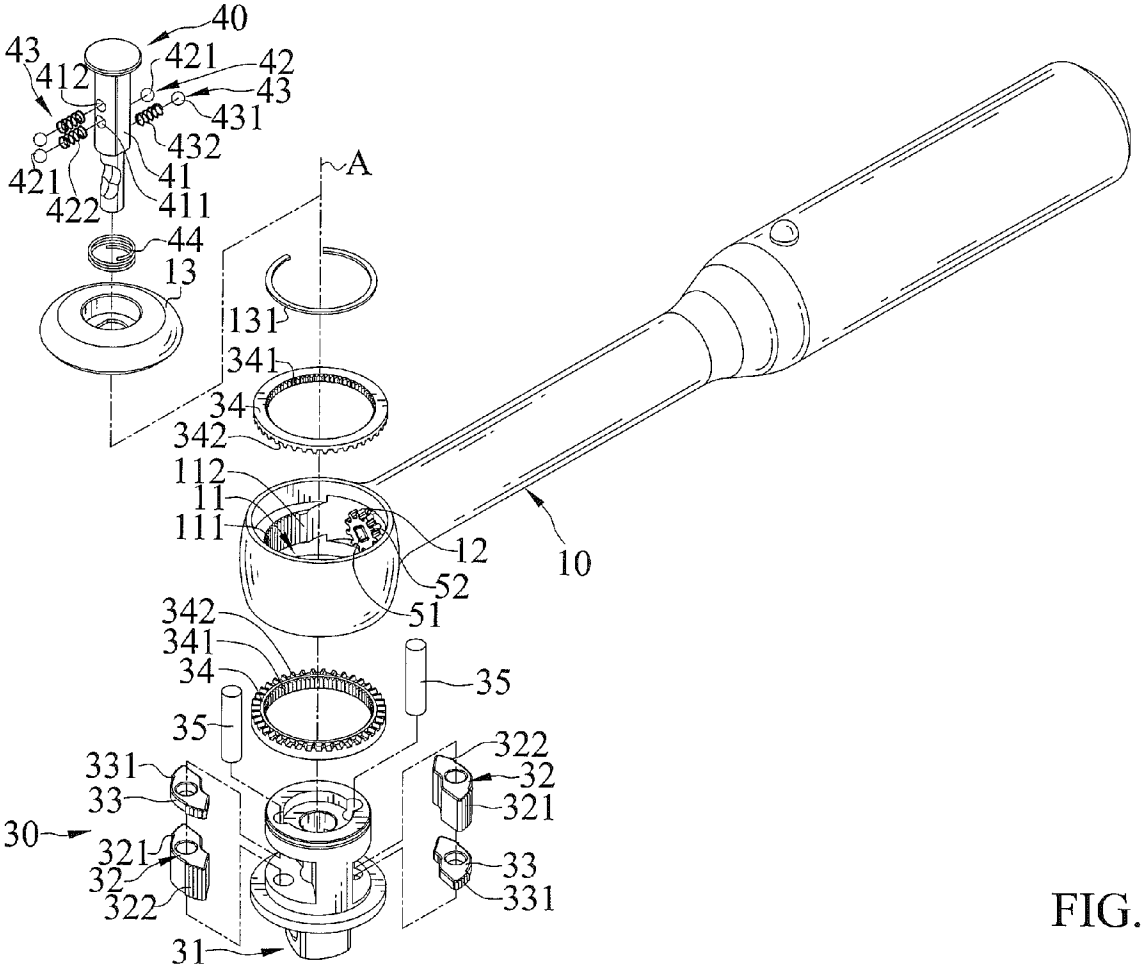
FIG. 1 is an exploded, perspective view of a ratchet wrench with tooth breakage resistance of a first embodiment according to the present invention.
Figure 2:
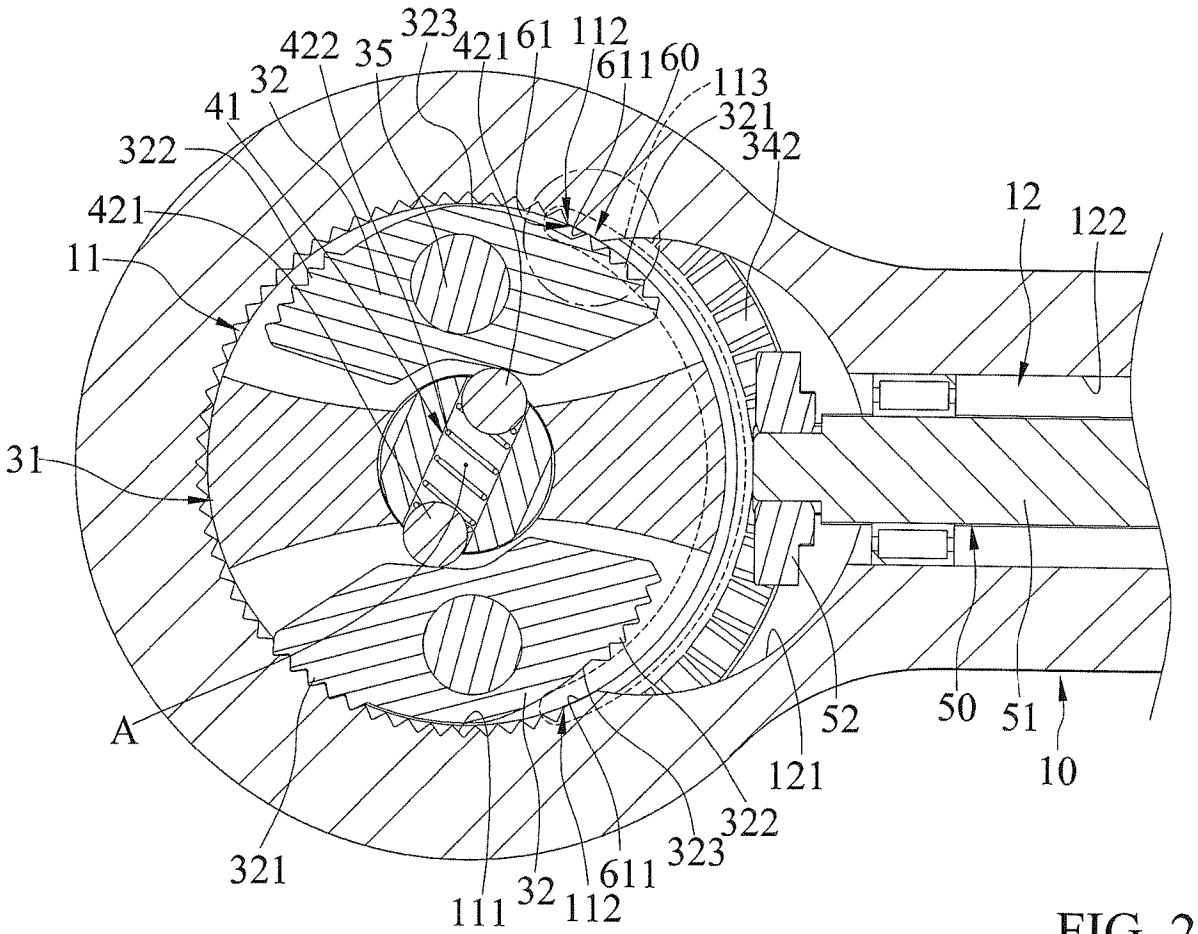
FIG. 2 is a partial, cross sectional view of the ratchet wrench of FIG. 1.
Figure 3:
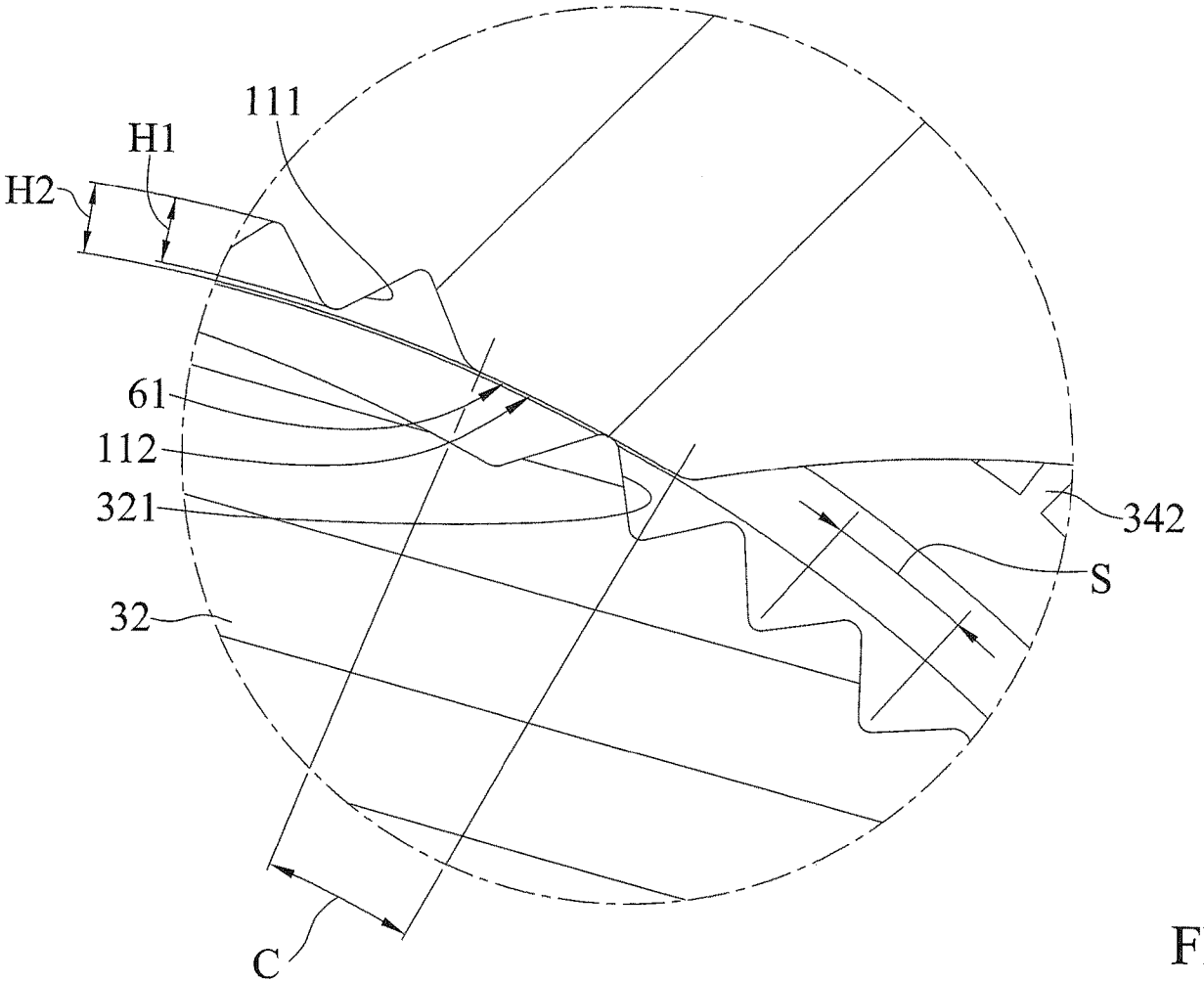
FIG. 3 is an enlarged view of a circled portion of FIG. 2.

With reference to FIGS. 1-3, a ratchet wrench with tooth breakage resistance of a first embodiment according to the present invention includes a body 10, a driving device 30, a transmission device 50, and a tooth breakage preventing device 60.

Body 10 includes a driving hole 11 and a transmission hole 12 intersecting with the driving hole 11. The driving hole 11 includes an inner periphery having a toothed portion 111 with a plurality of teeth. The transmission hole 12 has an end located in the inner periphery of the driving hole 11. The inner periphery of the driving hole 11 includes two adjoining portions 112 located on opposite sides of the end of the transmission hole 12 and spaced from each other in a circumferential direction of the driving hole 11. In this embodiment, the two adjoining portions 112 are symmetric to each other. An arcuate portion 113 extends between the two adjoining portions 112 and extends across the transmission hole 12 in the circumferential direction of the driving hole 11. In this embodiment, the arcuate portion 113 extends through about 145/180π rad (about 145°). Each tooth of the toothed portion 111 has a tooth height H1.

The driving hole 11 is defined in an end of the body 10 and extends along a rotating axis A. The transmission hole 12 includes a first portion 121 intercommunicated with the driving hole 11 and a second portion 122 intercommunicated with the first portion 121. The two adjoining portions 112 are on opposite sides of the first portion 121 in the circumferential direction of the driving hole 11.

In this embodiment, the body 10 further includes a cap 13 for closing the driving hole 11 through a retaining member 131.

The driving device 30 is rotatably received in the driving hole 11 and is adapted to drive a fastener, such as a bolt, a nut, or a socket. The driving device 30 includes a driving member 31 and two first pawls 32 pivotably mounted to the driving member 31. Each first pawl 32 includes first and second outer toothed sections 321 and 322. Each of the first and second outer toothed sections 321 and 322 has a plurality of teeth. The first and second outer toothed sections 321 and 322 of at least one of the first pawls 32 are selectively engaged with the toothed portion 111 of the driving hole 11.

In this embodiment, each first pawl 32 includes an arcuate section 323 between the first and second outer toothed sections 321 and 322.

The driving device 30 further includes two second pawls 33 pivotably mounted to the driving member 31 and two ring gears 34 rotatably received in the driving hole 11. Each ring gear 34 includes an inner toothed portion 341 and a side toothed portion 342. Each second pawl 33 includes two outer toothed sections 331 selectively engaged with an inner toothed portion 341 of one of the two ring gears 34. The two ring gears 34 can rotate about the rotating axis A in the clockwise direction or the counterclockwise direction relative to the driving member 31 and are located on opposite sides of the driving member 31 along the rotating axis A. The side toothed portion 342 of each ring gear 34 engages with and can be driven by the transmission device 50.

The driving device 30 further includes two pins 35 extending through the driving member 31, the first pawls 32 and the second pawls 33, such that each first pawl 32 and each second pawl 33 are pivotably mounted to the driving member 31 and are pivotable about pins 35. In this embodiment, each first pawl 32 has a thickness along the rotating axis A not larger than a diameter of the transmission hole 12. Preferably, the thickness of each first pawl 32 is smaller than the diameter of the transmission hole 12.

The transmission device 50 is rotatably mounted in the transmission hole 12 and is configured to drive the driving member 31 to rotate relative to the driving hole 11 about the rotating axis A. The transmission device 50 includes a transmission shaft 51 rotatably received in the second portion 122 of the transmission hole 12. A gear 52 is mounted on an end of the transmission shaft 51 and meshes with the side toothed portions 342 of the ring gears 34. The transmission shaft 51 can be driven manually or driven with a power to rapidly rotate relative to the transmission hole 12.

The tooth breakage preventing device 60 is mounted in the arcuate portion 113. The tooth breakage preventing device 60 is configured to be in contact with one of the first and second outer toothed sections 321 and 322 of either of the two first pawls 32 to prevent tooth breakage between the toothed portion 111 of the driving hole 11 and the one of the first and second outer toothed sections 321 and 322 of either of the two first pawls 32 when the body 10 is rotated to provide a ratcheting function for driving the fastener.

The tooth breakage preventing device 60 includes at least one contact portion 61 configured to be selectively in contact with one of the first and second outer toothed sections 321 and 322 of either of the two first pawls 32. The at least one contact portion 61 has a height H2 extending from a circumference of a root circle of the toothed portion 111 towards the driving hole 11 in a radial direction of the root circle of the toothed portion 111. The tooth height H1 of the toothed portion 111 is not larger than a height H2 of the at least one contact portion 61.

The at least one contact portion 61 of the tooth breakage preventing device 60 has an arc length C in the circumferential direction of the driving hole 11 centered on the rotating axis A. Each tooth of each of the first and second outer toothed sections 321 and 322 has a tooth thickness S. A ratio C/S of the arc length C to the tooth thickness S is not smaller than 0.5. In this embodiment, the ratio C/S is about 1.5. By such an arrangement, when the driving member 31 rotates relative to the driving hole 11, either of the first pawls 32 comes in contact with the at least one contact portion 61 to avoid one of the teeth of the first and second outer toothed sections 321 and 322 of either of the first pawls 32 from contacting with one of the teeth of the toothed portion 111 contiguous to a corresponding adjoining portion 112.

In this embodiment, the height H2 of the at least one contact portion 61 is larger than the tooth height H1 of the toothed portion 111 of the driving hole 11. Furthermore, the at least one contact portion 61 is a protrusion extending from the circumference of the root circle of the toothed portion 111 towards the driving hole 11 in the radial direction of the root circle of the toothed portion 111.

In this embodiment, the tooth breakage preventing device 60 includes two contact portions 61 integrally formed with the two adjoining portions 112, respectively. The two contact portions 61 respectively have two arcuate faces 611 selectively in contact with one of the first and second outer toothed sections 321 and 322 of either of the two first pawls 32. The two adjoining portions 112 are located in an intersection between the driving hole 11 and the transmission hole 12 and are symmetric to each other. The two arcuate faces 611 of the two contact portions 61 are symmetric to each other.

A direction switching device 40 is operably coupled to the first pawls 32 and the second pawls 33. The direction switching device 40 extends through the driving member 31 along the rotating axis A. The direction switching device 40 is configured to change an engagement status between the ring gears 34 and the first and second pawls 32 and 33 to change a ratcheting direction in which the fastener is driven by the driving member 31. In this embodiment, the direction switching device 40 includes a direction switching rod 41 extending through the cap 13 and the driving member 31 and a first pressing unit 42. The direction switching rod 41 is movable between two positions corresponding to a driving direction and a non-driving direction. The direction switching rod 41 includes a through-hole 411 extending in a direction perpendicular to the rotating axis A for receiving the first pressing unit 42. The first pressing unit 42 includes two pressing members 421 and a biasing element 422 between the pressing members 421. Each pressing member 421 is biased by the biasing element 422 to press against one of the first pawls 32. The direction switching device 40 further includes a returning spring 44 attached between the direction switching rod 41 and the cap 13 for returning purposes.

The direction switching rod 41 further includes two receptacles 412 respectively receiving the two second pressing units 43. Each second pressing unit 43 includes a pressing member 431 and a biasing element 432 for biasing the pressing member 431 to press against one of the second pawls 33.

A user can rapidly drive transmission shaft 51 to rotate. Due to the engagement between the gear 52 and the side toothed portions 342 of the ring gears 34 and the engagement between the inner toothed portions 341 of the ring gears 34 and the outer toothed sections 331 of the second pawls 33, the driving member 31 is driven to rotate relative to the driving hole 11, thereby rapidly driving the fastener.

When the fastener has been tightened to an extent, in order to reach the tightness demanded by the user, the body 10 is rotated in the counterclockwise direction. Due to the engagement status between the first outer toothed sections 321 or the second outer toothed sections 322 of the first pawls 32 and the toothed portion 111 of the driving hole 11, the driving member 31 is further rotated relative to the driving hole 11 to further drive the fastener. Then, the user can rotate body 10 in the clockwise direction, such that the first outer toothed sections 321 or the second outer toothed sections 322 of the first pawls 32 disengage from and then reengage with the toothed portion 111 of the driving hole 11.

During repeated clockwise and counterclockwise rotations of the body 10 to provide the ratcheting function, the driving member 31 rotates relative to the driving hole 11. When either of the first pawls 32 reaches the arcuate portion 113, one of the contact portions 61 of the tooth breakage preventing device 60 comes into contact with the first outer toothed section 321 or the second outer toothed section 322 of the first pawl 32. Since the height H2 is larger than the tooth height H1, either of the contact portions 61 in the form of a protrusion avoids any tooth of the first outer toothed section 321 or the second outer toothed section 322 of the first pawl 32 from contacting with one of the teeth of the toothed portion 111 contiguous to the corresponding adjoining portion 112. This prevents tooth breakage resulting from application of a force by the user in a single-tooth engagement state before complete engagement between the toothed portion 111 of the driving hole 11 and the first outer toothed section 321 or the second outer toothed section 322.

Furthermore, the ratio of the arc length C to the tooth thickness S is not smaller than 0.5, such that a manufacturer of the ratchet wrench with tooth breakage resistance according to the present invention can adjust the arc length C of each contact portion 61 according to the tooth thickness S. This assures either of the contact portions 61 comes into contact with either of the first pawls 32 while the driving member 31 rotates relative to the driving hole 11, achieving the tooth breakage preventing effect.

Figure 4:
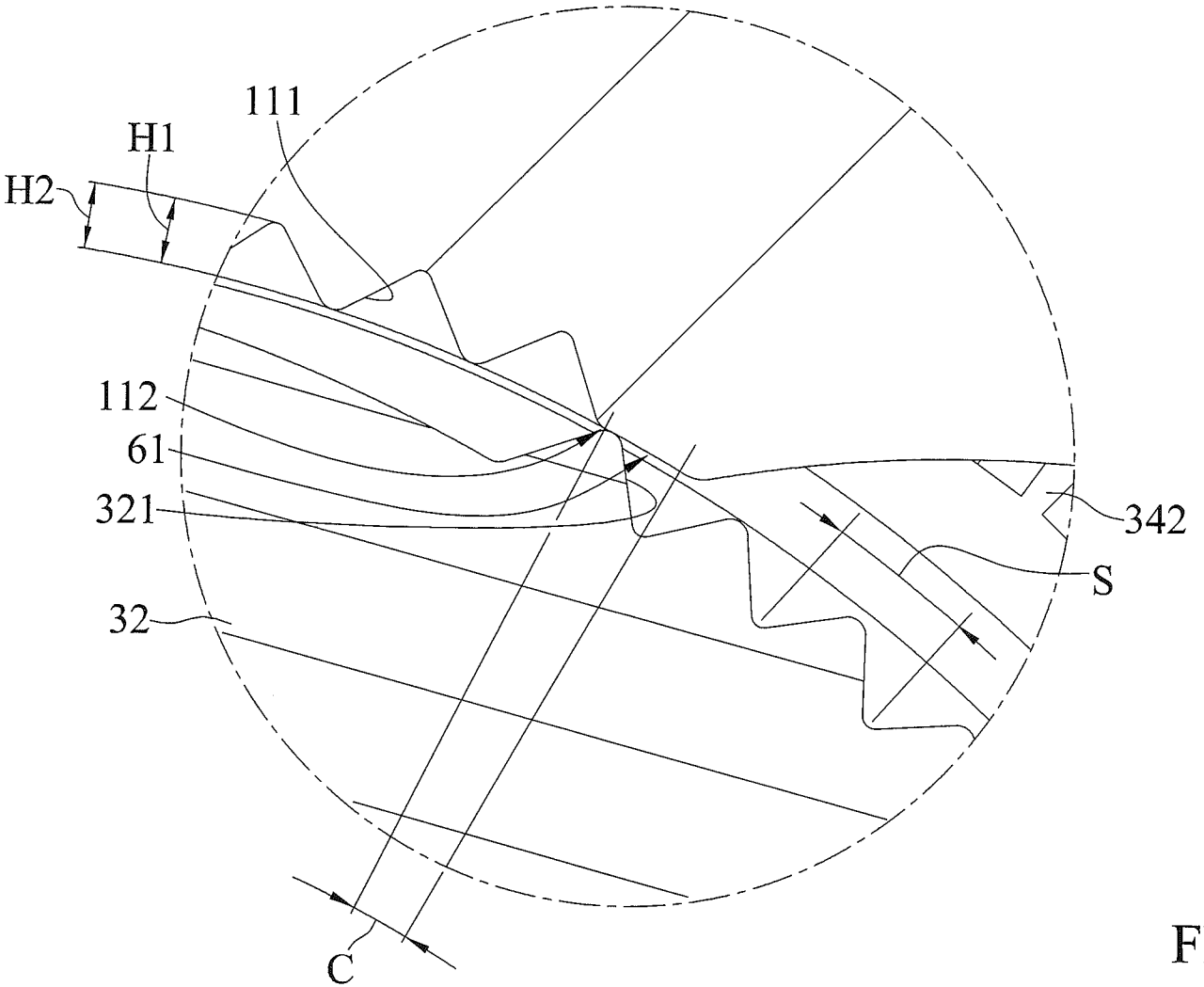
FIG. 4 is a view similar to FIG. 3, illustrating a ratchet wrench with tooth breakage resistance of a second embodiment according to the present invention.
Figure 5:
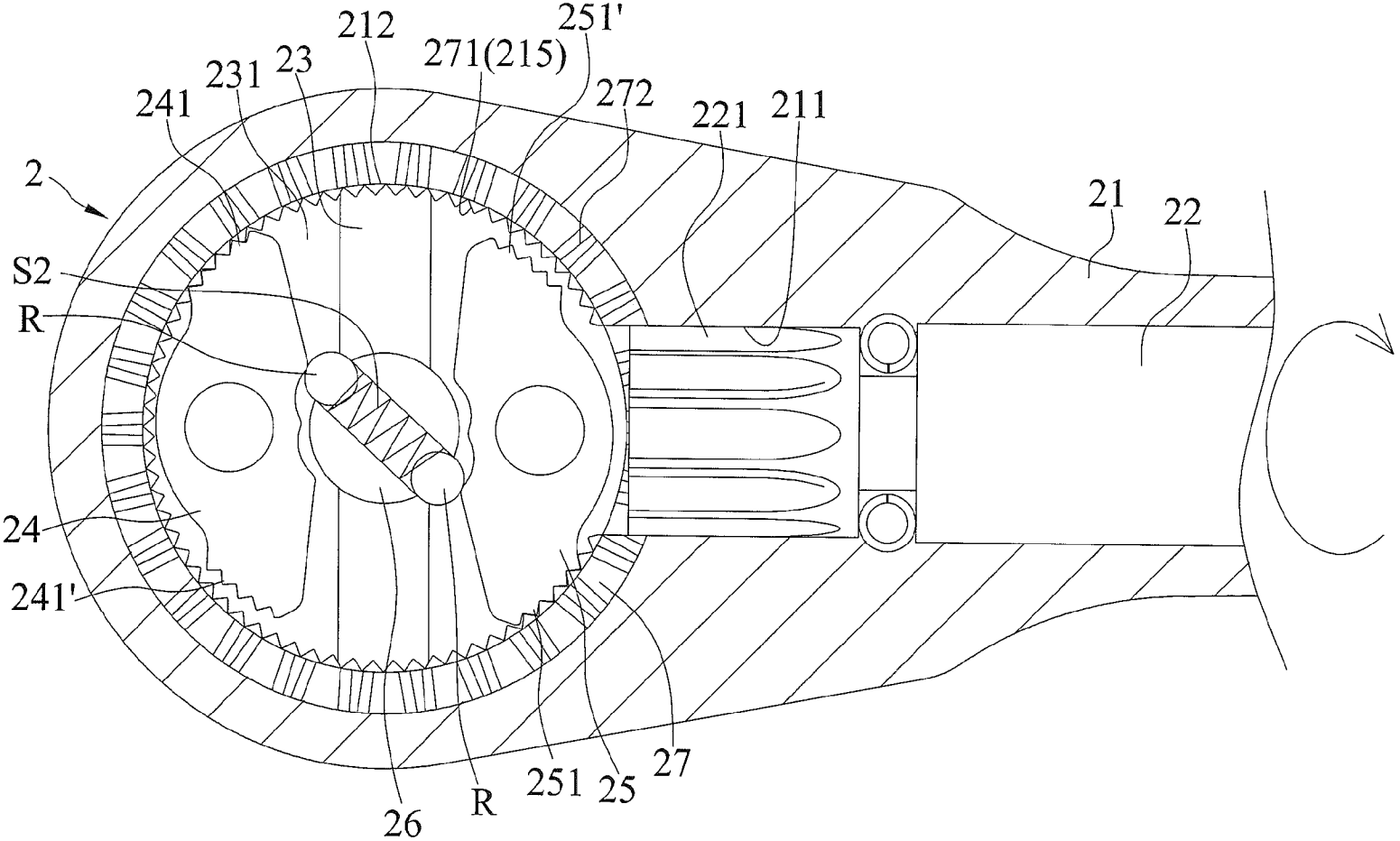
FIG. 5 PRIOR ART
FIG. 5 is a diagram of a conventional ratchet wrench, with two first outer teeth of two first pawls engaged with inner teeth of a groove of a main body of the conventional ratchet wrench.
Figure 6:
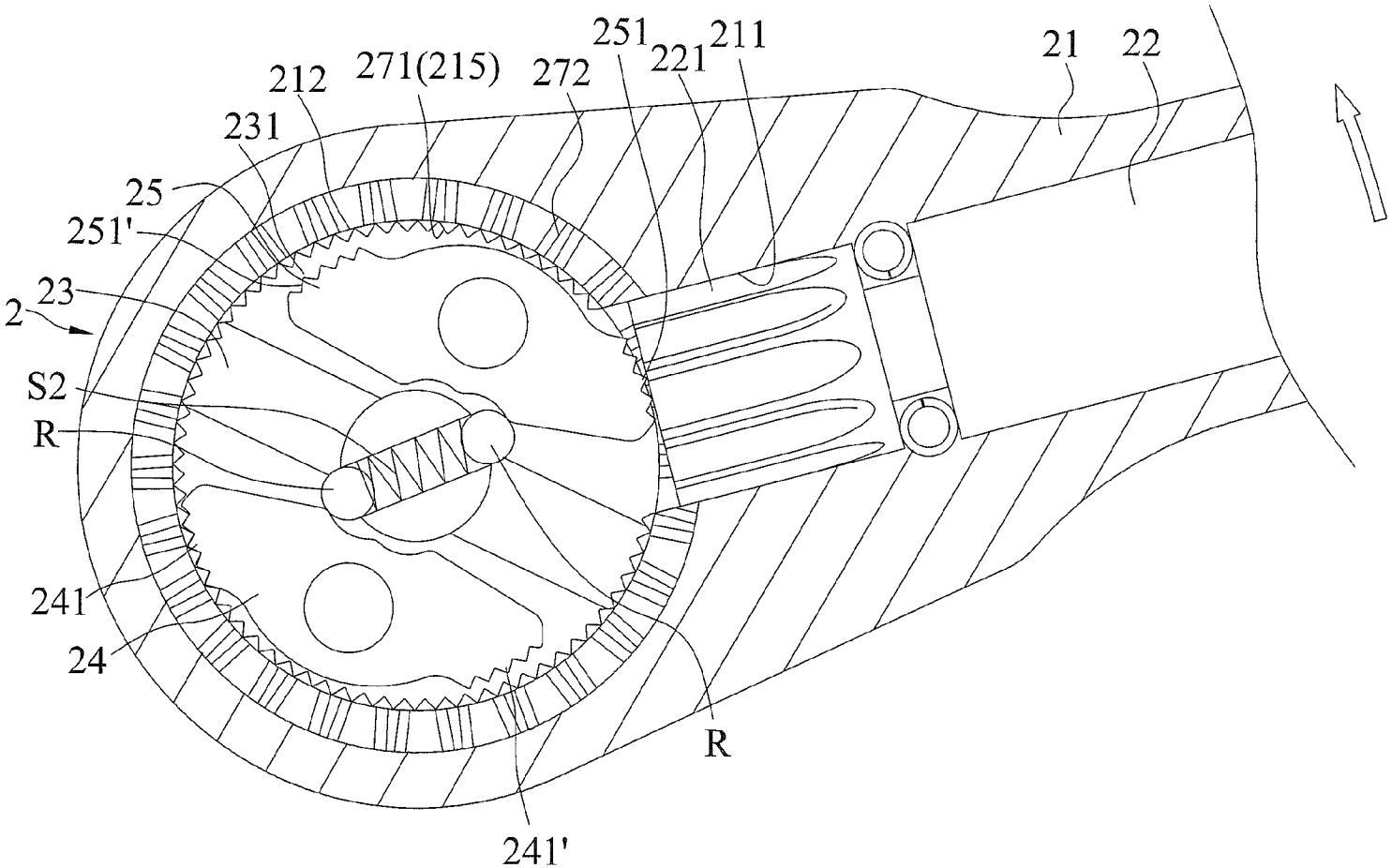
FIG. 6 PRIOR ART
FIG. 6 is a diagram showing a continuing operation on the ratchet wrench in the state shown in FIG. 5, with the main body rotated in the counterclockwise direction and with one of the first pawls fallen into a through-hole of the main body and in contact with an end of a drive shaft.
Figure 7:
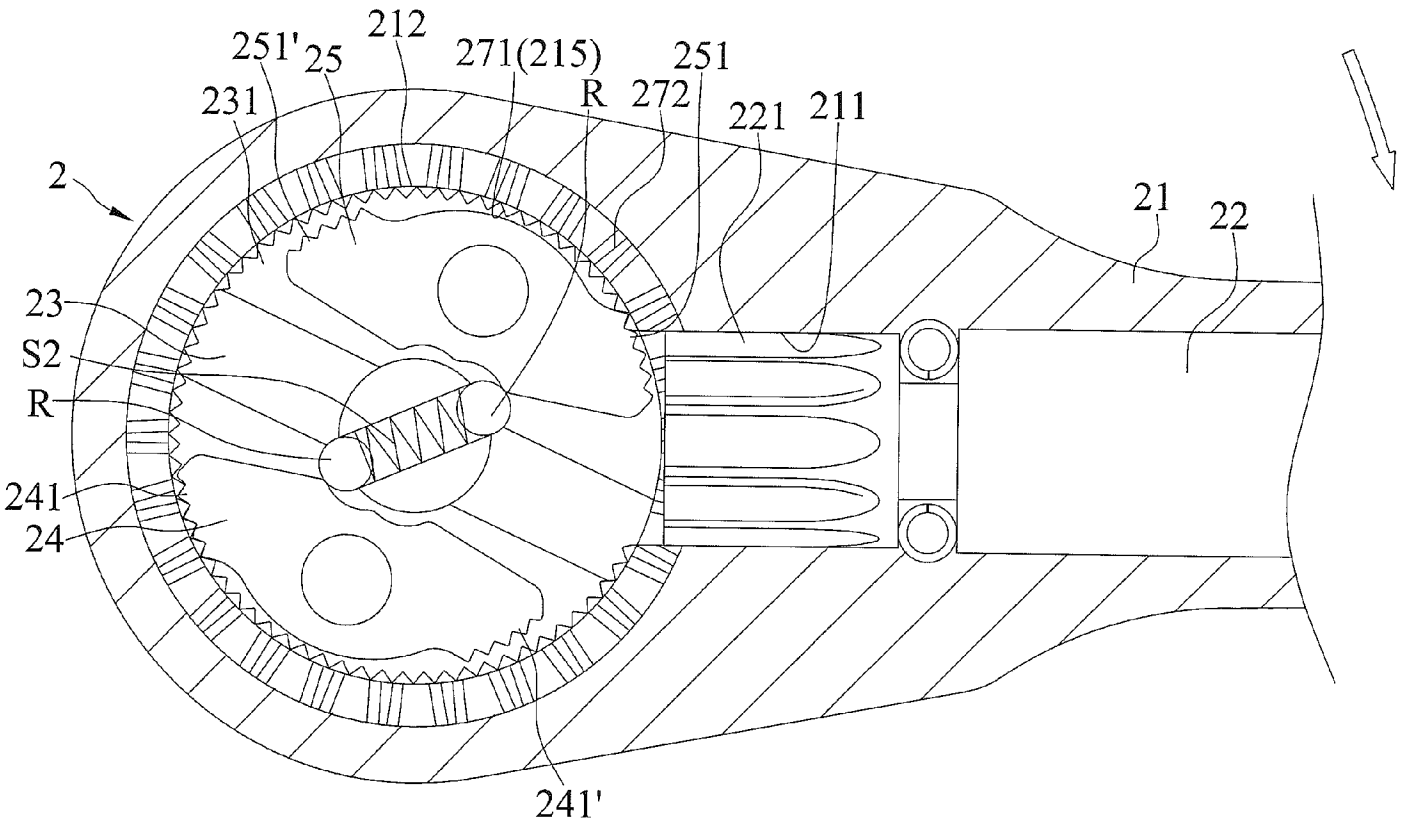
FIG. 7 PRIOR ART
FIG. 7 is a diagram showing a continuing operation on the ratchet wrench in the state shown in FIG. 6, with the main body rotated in the clockwise direction, with the first pawls and the inner teeth of the groove providing a ratcheting function, and with the drive member rotated idly.
Figure 8:
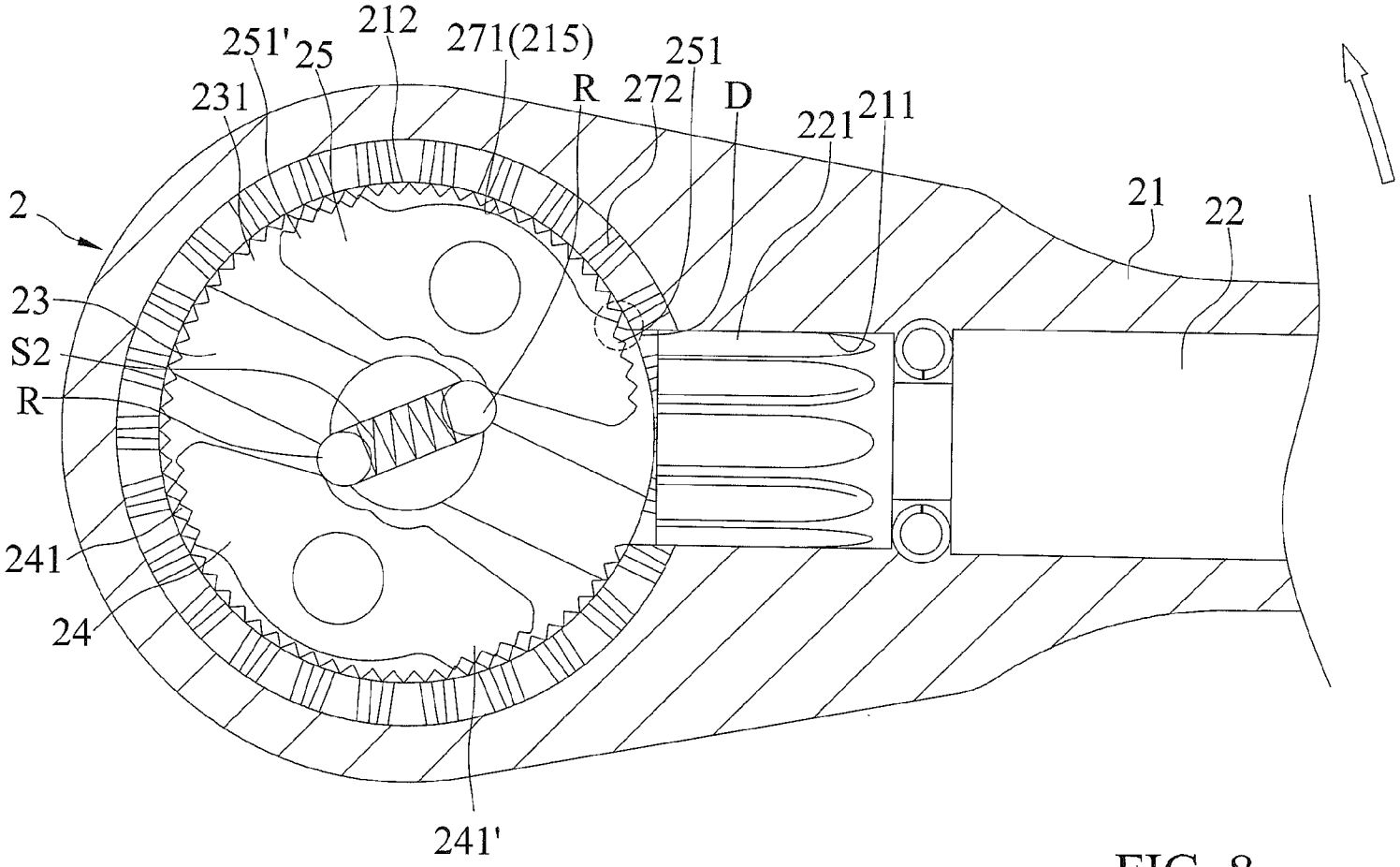
FIG. 8 PRIOR ART
FIG. 8 is a diagram illustrating a state immediately before FIG. 7, with only one of the first outer teeth of a second pawl engaged with one of the inner teeth in the groove adjacent to a through-hole of the main body by a relatively small contact area.
Figure 9:
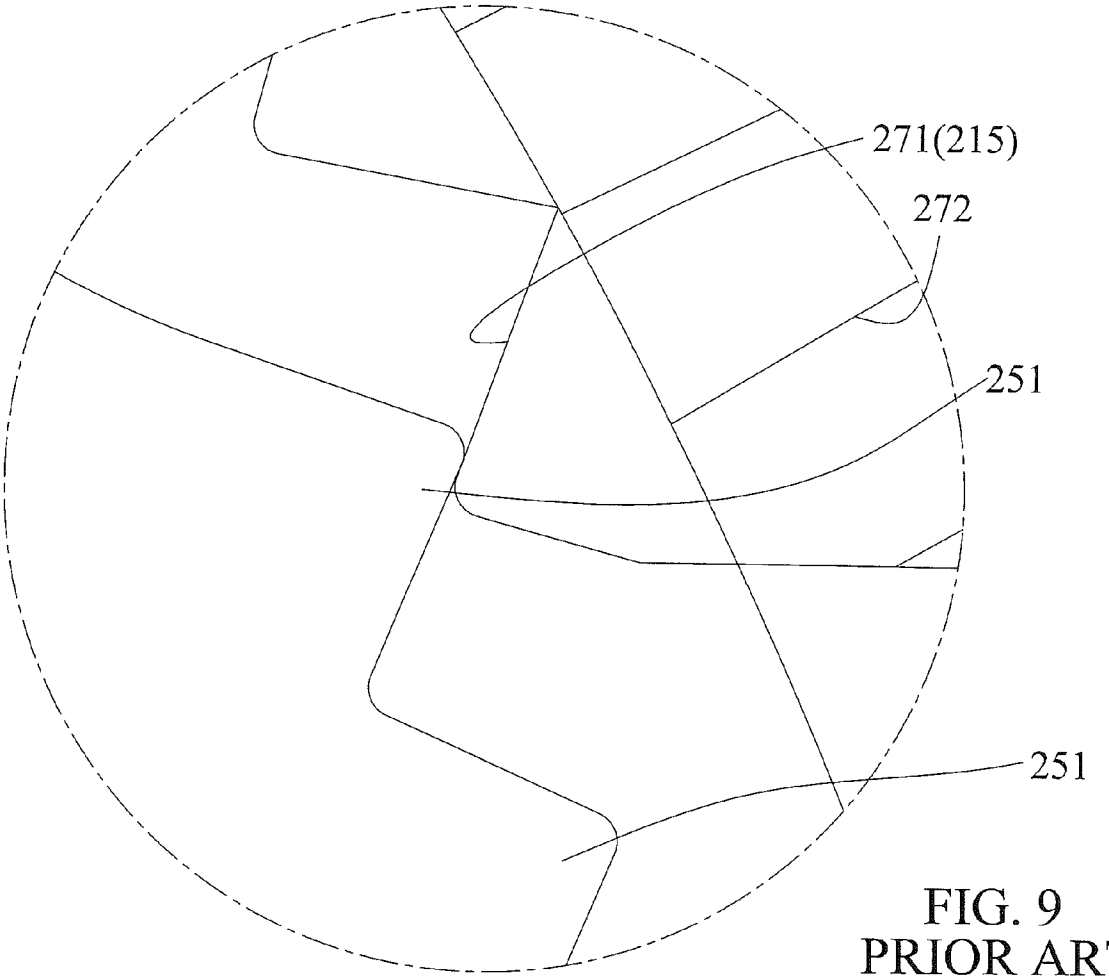
FIG. 9 PRIOR ART
FIG. 9 is an enlarged view of a circled portion of FIG. 8.
Figure 10:
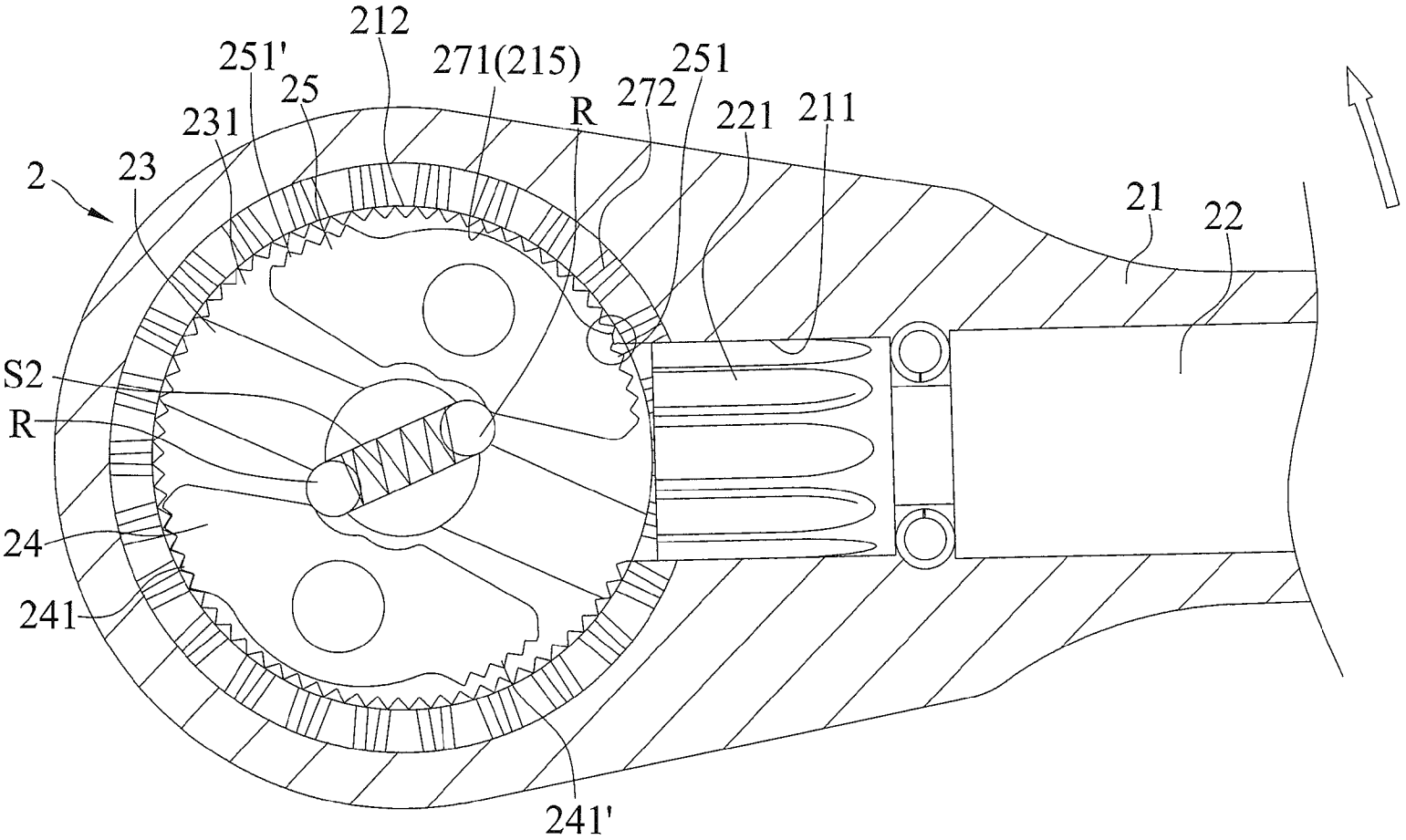
FIG. 10 PRIOR ART
FIG. 10 is a diagram showing a continuing operation on the ratchet wrench in the state shown in FIG. 9, illustrating tooth breakage due to the main body rotated while the first outer teeth of the second pawl and the inner teeth in the groove adjacent to the through-hole in a non-complete engagement.
Figure 11:
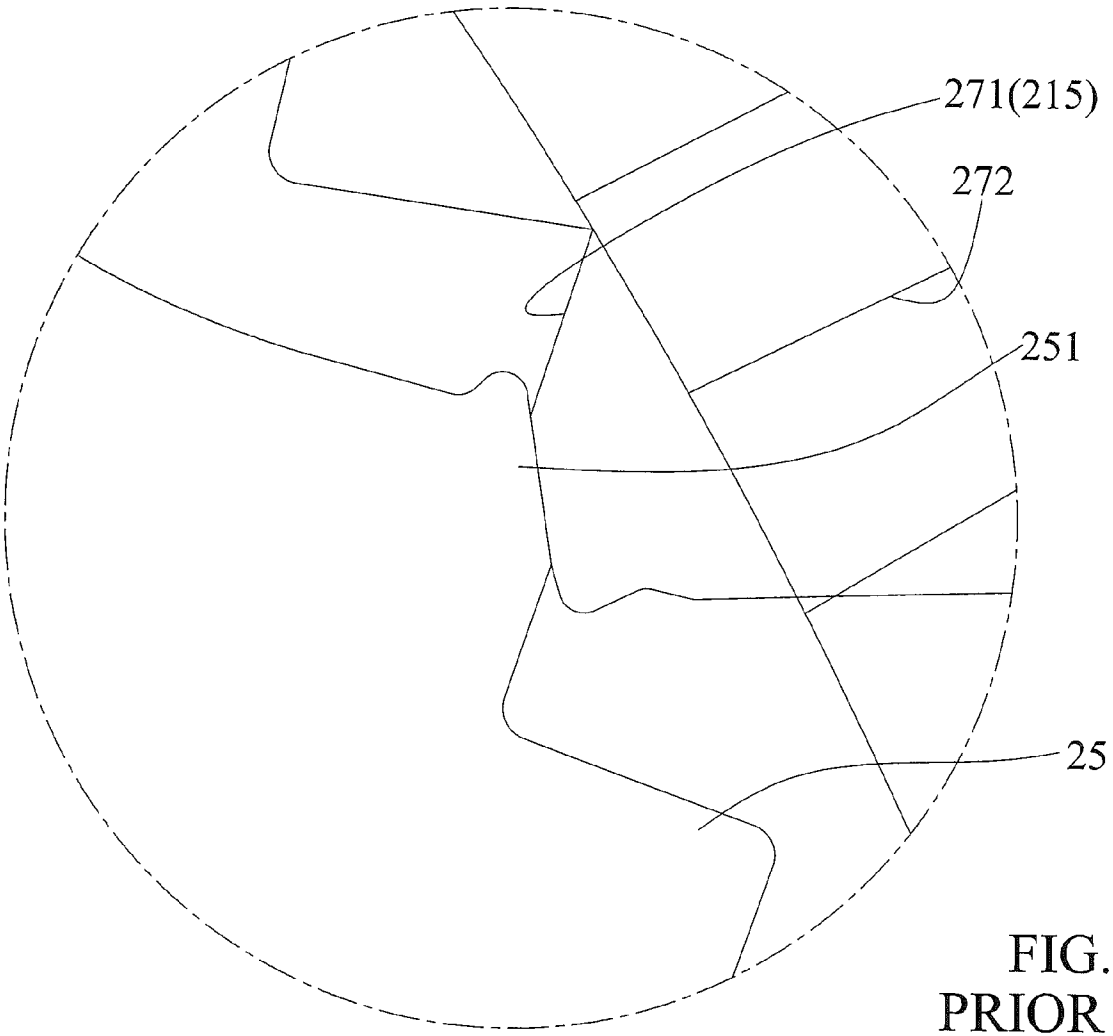
FIG. 11 PRIOR ART
FIG. 11 is an enlarged view of a circled portion of FIG. 10.

FIG. 4 shows a ratchet wrench with tooth breakage resistance of a second embodiment according to the present invention. The second embodiment is substantially the same as the first embodiment. The second embodiment is different from the first embodiment by that the height H2 of the at least one contact portion 61 is equal to the tooth height H1 of the toothed portion 111 of the driving hole 11. Furthermore, the at least one contact portion 61 and the two adjoining portions 112 are located in the circumferential direction of the driving hole 11. Thus, when either of the first pawls 32 reaches the arcuate portion 113, the tooth breakage preventing device 60 comes into contact with the first outer toothed section 321 or the second outer toothed section 322 of the first pawl 32 to provide tooth breakage resistance. Furthermore, the ratio of the arc length C to the tooth thickness S is about 0.5 (which is different from the first embodiment), such that the manufacturer of the ratchet wrench can adjust the arc length C of each contact portion 61 according to the tooth thickness S.

Although specific embodiments have been illustrated and described, numerous modifications and variations are still possible without departing from the scope of the invention. The scope of the invention is limited by the accompanying claims.

The invention claimed is:

1. A ratchet wrench comprising:

a body including a driving hole and a transmission hole intersecting with the driving hole, with the driving hole including an inner periphery having a toothed portion with a plurality of teeth, with the inner periphery of the driving hole including two adjoining portions on opposite sides of the transmission hole in a circumferential direction of the driving hole, with an arcuate portion extending between the two adjoining portions and extending across the transmission hole in the circumferential direction of the driving hole;

a driving device rotatably received in the driving hole and adapted to drive a fastener, with the driving device including a driving member and two first pawls pivotably mounted to the driving member, with each of the two first pawls including first and second outer toothed sections, with each of the first and second outer toothed sections having a plurality of teeth, with the first and second outer toothed sections of at least one of the two first pawls selectively engaged with the toothed portion of the driving hole;

a transmission device rotatably mounted in the transmission hole, with the transmission device configured to drive the driving member to rotate relative to the driving hole about a rotating axis; and a tooth breakage preventing device provided in the arcuate portion and including two contact portions respectively integrally formed on the two adjoining portions, with the two contact portions respectively having two faces, with each of the two faces configured to be selectively in contact with one of the first and second outer toothed sections of either of the two first pawls to prevent tooth breakage between the toothed portion of the driving hole and the one of the first and second outer toothed sections of either of the two first pawls when the body is rotated to provide a ratcheting function for driving the fastener.

2. The ratchet wrench as claimed in claim 1, with each of the two contact portions including a height extending from a circumference of a root circle of the toothed portion towards the driving hole in a radial direction of the root circle, and with each of the plurality of teeth of the toothed portion of the driving hole having a tooth height not larger than the height of each of the two contact portions.

3. The ratchet wrench as claimed in claim 2, with the height of each of the two contact portions being larger than the tooth height of the toothed portion of the driving hole, and with each of the two contact portions being a protrusion extending from the circumference of the root circle of the toothed portion towards the driving hole in the radial direction of the root circle.

4. The ratchet wrench as claimed in claim 2, wherein the height of each of the two contact portions is equal to the tooth height of the toothed portion of the driving hole, and wherein the two contact portions and the two adjoining portions are located in the circumferential direction of the driving hole.

5. The ratchet wrench as claimed in claim 2, with the driving hole defined in an end of the body and extending along the rotating axis, with each of the two contact portions of the tooth breakage preventing device having an arc length in the circumferential direction of the driving hole centered on the rotating axis, with each of the two first pawls including an arcuate section between the first and second outer toothed sections, with each of the first and second outer toothed sections including a plurality of teeth, with each of the plurality of teeth of each of the first and second outer toothed sections having a tooth thickness, and with a ratio of the arc length to the tooth thickness being not smaller than 0.5.

6. The ratchet wrench as claimed in claim 2, with the two faces being two arcuate faces.

7. The ratchet wrench as claimed in claim 6, wherein the two adjoining portions are located in an intersection between the driving hole and the transmission hole and are symmetric to each other, and wherein the two arcuate faces of the two contact portions are symmetric to each other.

* * * * *